United States Patent [19]

Dornbusch

[11] Patent Number: 4,491,000

[45] Date of Patent: Jan. 1, 1985

[54] METHOD AND APPARATUS FOR IMPROVED SENSING OF ROLL SEPARATION FORCE IN A ROLLING MILL

[75] Inventor: Paul E. Dornbusch, Roanoke, Va.

[73] Assignee: General Electric Company, Salem, Va.

[21] Appl. No.: 509,598

[22] Filed: Jun. 30, 1983

[51] Int. Cl.[3] ..... B21B 37/08

[52] U.S. Cl. ..... 72/8; 72/19; 72/20; 364/472

[58] Field of Search ..... 364/472; 72/8, 19, 20, 72/21, 16, 237, 240

[56] References Cited

U.S. PATENT DOCUMENTS

| | | | |
|---|---|---|---|
| 2,972,268 | 2/1961 | Wallace et al. | 72/8 |
| 3,269,160 | 8/1966 | Halter et al. | 72/8 |
| 3,478,551 | 11/1969 | Alsop | 72/8 |
| 3,714,806 | 2/1973 | Berkey et al. | 72/19 |

OTHER PUBLICATIONS

"Mill Modulus Variation and Hysteresis—Their Effect on Hot Strip Mill AGC" by G. E. Wood et al. *Iron and Steel Engineer Yearbook,* 1977, pp. 33–39.

"Force Sensing in Rolling Mills" by A. Zeltkalns et al. *Iron and Steel Engineer Yearbook,* 1977, pp. 40–46.

*Primary Examiner*—Lowell A. Larson
*Assistant Examiner*—Steven B. Katz
*Attorney, Agent, or Firm*—Arnold E. Renner

[57] ABSTRACT

A rolling mill stand, including a housing for supporting a pair of opposed rolls for reducing the thickness of a workpiece passed therebetween and an apparatus for adjusting the gap between the rolls, has associated therewith a scheme for controlling the apparatus for adjusting the gap in response to combined results of a first signal representing the force occasioned by the workpiece between the rolls and a second signal representing the strain established in the housing as a result of the workpiece between the rolls.

8 Claims, 3 Drawing Figures

METHOD AND APPARATUS FOR IMPROVED SENSING OF ROLL SEPARATION FORCE IN A ROLLING MILL

BACKGROUND OF THE INVENTION

The present invention relates generally to rolling mills and more particularly to a method and apparatus for providing a more accurate signal, representing the actual roll separation force occasioned by the presence of a workpiece between the rolls of the mill, for use with an automatic gage control system.

One well known method of controlling workpiece gage is that which is commonly referred to as the BISRA gagemeter automatic gage control (AGC) system. In this system the force associated with and generated by the workpiece as it passes through the stand workrolls is sensed and combined with a signal proportional to roll position to form a signal representative of workpiece thickness which is used in a closed loop system to adjust the gap or opening between the opposed workrolls. In applications where incoming workpiece hardness and thickness variations are less significant than mill roll irregularities, such as eccentricity or ovalness, the thickness control strategy may be used for regulation of rolling force on the assumption that constant rolling force will produce uniform output thickness.

There are at least two well known methods of sensing this force. The first of these methods is what is here termed the direct method and commonly uses load cells placed between the mill housing and the roll gap to provide an output force signal. An alternative to using the load cells, where such is used, is to sense the pressure within a hydraulic cylinder which is used as a gap adjusting means in the automatic gage control system. The second method which is here termed an indirect method uses strain gages, located on the mill housing, to measure the strains on that housing when a workpiece is being rolled.

In practice neither of these systems has been as accurate as might be anticipated. One of the prime causes of inaccuracies in the direct method is friction. As is well known in the art, friction exists between the mill stand housing and the chocks which support the rolls as well as in certain hydraulic elements such as balancing jacks which are used to maintain the roll chocks in position and, where used, the hydraulic roll gap adjustment mechanism. Since both gagemeter and force control systems employ the use of a force feedback signal, it is apparent that any forces seen by the force sensor in addition to those forces produced by reduction of the workpiece will tend to degrade the accuracy of that force signal as a true representation of the actual rolling force. It must be remembered that in all gage control systems the gap between the rolls is repeatedly being changed in an attempt to effect constant output gage as a function of the force feedback signal.

It is also recognized in the art that the frictional forces are not constant but vary in accordance with mill conditions and the direction of roll travel as the roll gap being adjusted. These produce what in effect is commonly referred to as a hystereis. A more complete discussion of the frictional forces and the hystereis effect may be had by reference to the following two articles:

(a) "Mill modulus variations in hystereis—Their affect on hot mill AGC" by G. E. Wood et al., *Iron and Steel Engineer Yearbook,* 1977, pages 33 through 39; and, (b) "Force sensing in rolling mill" by A. Zelpkalns et al., *Iron and Steel Engineer Yearbook,* 1977, pages 40 through 46.

The strain gage method of producing the force signal is far less susceptible to friction forces than the direct method just discussed but is highly susceptible to temperature. That is, the strain gage method does not see chock-housing frictions, which are normally the largest components of friction, although it is somewhat susceptible to friction of the gap adjusting cylinder as well as balance jack cylinder friction when the workroll balance jacks are between the workroll chocks and not abutting the housing. Temperature, on the other hand, plays a significant factor in the output of the strain gage system and in order to make this system practical, the strain gage must be continuously calibrated for temperature. This is not practical in many instances, particularly when the rolling mill is continuous rather than reversing and the time between unloaded states may be several minutes.

SUMMARY OF THE INVENTION

It is, therefore, an object of the present invention to provide an improved means for developing a signal representative of the true rolling force in a rolling mill stand.

It is another object to provide an improved method and apparatus for developing an accurate signal representing rolling force in a rolling mill for use with an automatic gage control system.

It is a further object to provide an improved method and apparatus for developing an accurate signal representing rolling force in a rolling mill for use with an automatic gage control system which uses both a direct method and an indirect method of force measurement.

It is a still further object to provide an improved method and apparatus for developing an accurate signal representing rolling force in a rolling mill stand for use with an automatic gage control system which employs both a direct sensing of the rolling force and also the sensing of strain in the housing of the mill.

The foregoing and other objects are achieved, for use in conjunction with a rolling mill having a housing for supporting roll elements for reducing the thickness of a workpiece passed therebetween and adjusting means for adjusting the gap between said roll elements, by producing a first or force signal which represents the force occasioned by the presence of a workpiece between the roller elements. There is further provided a strain signal representing the strain forces produced in the mill housing by the presence of the workpiece between the roll elements. These two signals are then combined to develop a control signal which is then applied to the automatic gage control system to control the roll gap opening.

BRIEF DESCRIPTION OF THE DRAWING

While the present invention is defined in the claims annexed to and forming a part of this specification, a better understanding of the invention can be had with reference to the following description taken in conjunction with the accompanying drawing in which:

DETAILED DESCRIPTION

Figure 1:
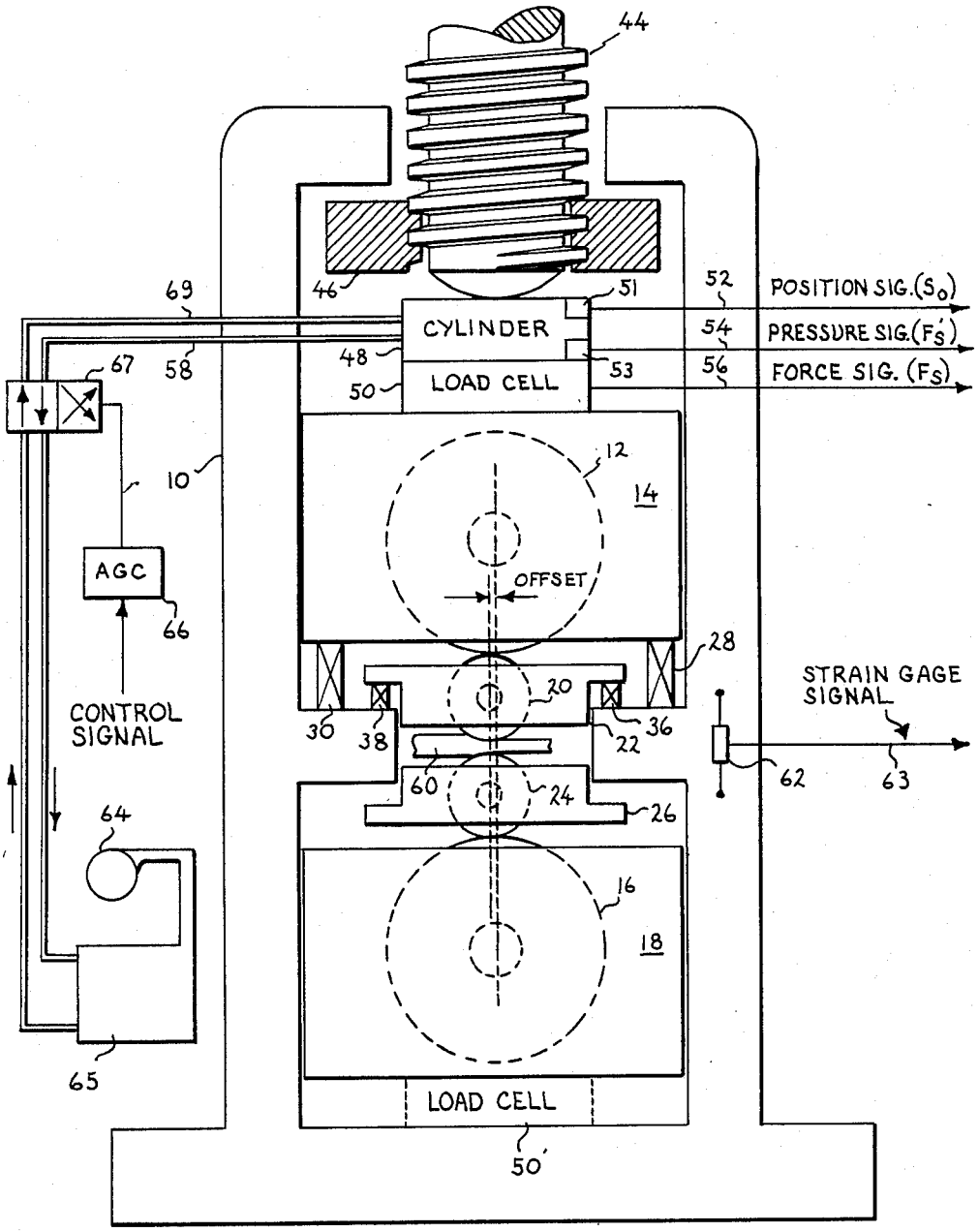
FIG. 1 is a schematic end view of the typical mill stand having automatic gage control, useful in understanding the present invention.

Reference is now made to FIG. 1 which shows in schematic form the end view of a typical four-high mill stand including automatic gage control. As illustrated, the stand has a housing 10 for containing the stand elements which include an upper backup roll 12 which is journaled in a suitable chock means 14. A lower backup roll 16 is similarly journaled in a chock 18. A pair of workrolls shown at 20 and 24 are journaled to respective chocks 22 and 26. Two pairs of balance jacks serve to support the upper chocks with respect to the mill housing. Thus, the first pair of balance jacks 28 and 30 is positioned between the housing and the upper backup roll chock 14. Workroll balance jacks 36 and 38 support the upper workroll chock 22. Similar chocks and jacks would, of course, exist on the other end of the stand. As is customary, a suitable screw mechanism 44 acting through a nut 46 serves to provide rough dimensioning of the space (gap) between the two workrolls 20 and 24 through which a workpiece 60 is passed. In the present illustration there is further included, immediately below the screw 44, a hydraulic system illustrated at 48 which is essentially a piston within a cylinder, (collectively, herein referred to as the "cylinder") which will, as is known in the art, serve to provide adjustment in accordance with the automatic gage control (AGC) system. It is also known that the cylinder can be omitted and have the AGC work directly through the screw 44. The screw 44 and cylinder 48 act on the backup roll chock 14 by way of a load cell 50. The load cell 50, as is well recognized in the art, provides an output signal ($F_S$-line 56), which is proportional to the rolling force resulting from the workpiece 60 being passed between the workrolls 20 and 24 as modified by the friction forces as earlier described. (Depicted in phantom form between the upper backup roll chock 18 and the housing is a load cell 50'. This is meant to show an alternative location of the load cell which is sometimes employed).

Associated with cylinder 58 are two sensing means 51 and 53 which are commonly provided with the cylinder. Sensing means 51 provides an output signal ($S_o$) on line 52 which is indicative of the position of the piston within the cylinder and hence an indication of the roll gap. Sensor 53 is a pressure sensor which senses the internal pressure within the cylinder and provides a pressure signal ($F_S'$) on output line 54 which may also be utilized as an indication of the rolling force.

A second means for providing a signal indicative of the rolling force is indicated by a strain gage 62 which is affixed to the housing 10 of the mill stand. In the depiction at FIG. 1, which is the end view of the mill housing, only one such strain gage 62 is shown. It is, however, to be understood that, as is customary in the art, at least one additional strain gage would be present at the other end of the mill stand and quite often two additional strain gages would be applied on the other side of each end of the mill housing such that there would be four such strain gages 62 all located on the downstream side of the stand. As such the strain gage 62 in FIG. 1 is intended to be representative of all the total strain gage system and provides a strain gage output signal on line 63.

In order to adjust the roll gap in the depiction in FIG. 1, hydraulic fluid is supplied from a high pressure system 65 to the cylinder 48 by way of a suitable conduit 69 and servo control valve 67. Return path from the cylinder is through conduit 58. System pressure is maintained by a pump 64. The servo control valve 67 is under control of the AGC system 66 which in turn is responsive to a control signal the generation of which is the subject of the present invention. If no cylinder were present, the AGC system would serve to control the screw 44.

As earlier indicated, the present invention employs the use of a direct force signal such as might be derived from a load cell or a cylinder pressure sensor in combination with a strain gage signal to develop the control signal for the AGC system such as is shown in FIG. 1.

Figure 2:
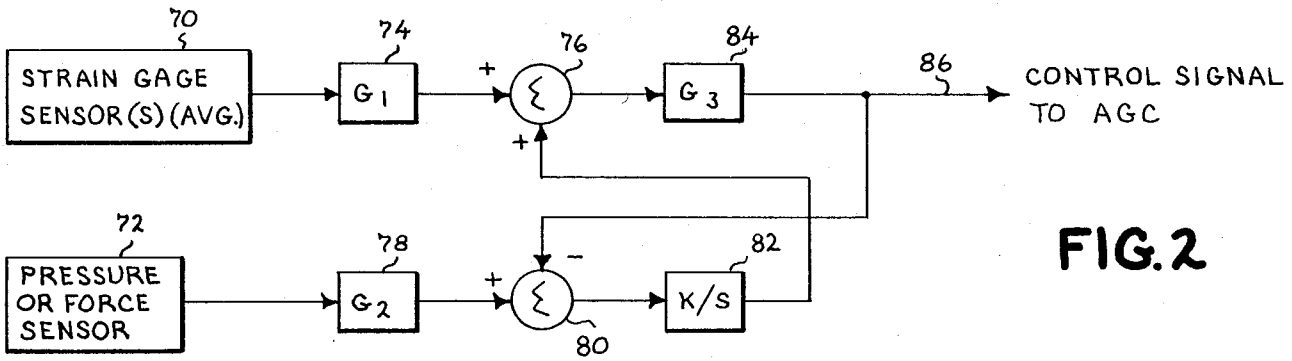
FIG. 2 is a schematic functional diagram illustrating the scheme of the present invention in its preferred embodiment.

FIG. 2 illustrates in block functional form the manner in which this is achieved in accordance with the present invention. As shown in FIG. 2, block 70 represents the strain gage sensors outputs which are provided to a simple gain block 74 which has a gain appropriate to scaling desired. (For example, if four strain gages were employed and the gain of the block 74 were 0.25, the output of the block would be equal to the average of the strain gage signals.) The output of the gain block 74 is applied as a positive input to a summing junction 76. The pressure or force signal from either the cylinder pressure sensor or the load cell is represented at 72 and this signal is applied to a suitable gain block 78 which provides appropriate scaling. The output of this block is applied in the positive sense to a summing junction 80. The output of summing junction 76, which also has a negative input to be later discussed, is applied to a suitable gain block 84, the output of which, on line 86, is the control signal supplied to the AGC system. This output of gain block 84 is also applied in negative sense to summing junction 80 and the output of this summing junction is applied to an integrating function block 82 having a transfer function of K/S, wherein, K is a constant and S is Laplace transform operator. The output of the integrating function of block 82 is applied in the positive sense to the summing junction 76 as earlier indicated. The effect of the cross tie arrangement between the outputs and inputs of function blocks 82 and 84 is to force the output of block 84 to be equal to the output of block 78 on a long term basis through the use of the integrating function block 82. Thus, there is provided a temperature compensation scheme which automatically calibrates the strain gage to effect a control signal for the AGC system.

The overall loop producing the drift corrected signal on line 86 must be fast enough to cancel temperature related drift errors but slow enough to ignore normal force changes due to strip variations, friction, etc. As such, the constant K would normally have a value no greater than 0.1 and not less than 0.03, the later value to avoid temperature drift errors which may become significant in some relatively short period of time, for example, one minute.

Figure 3:
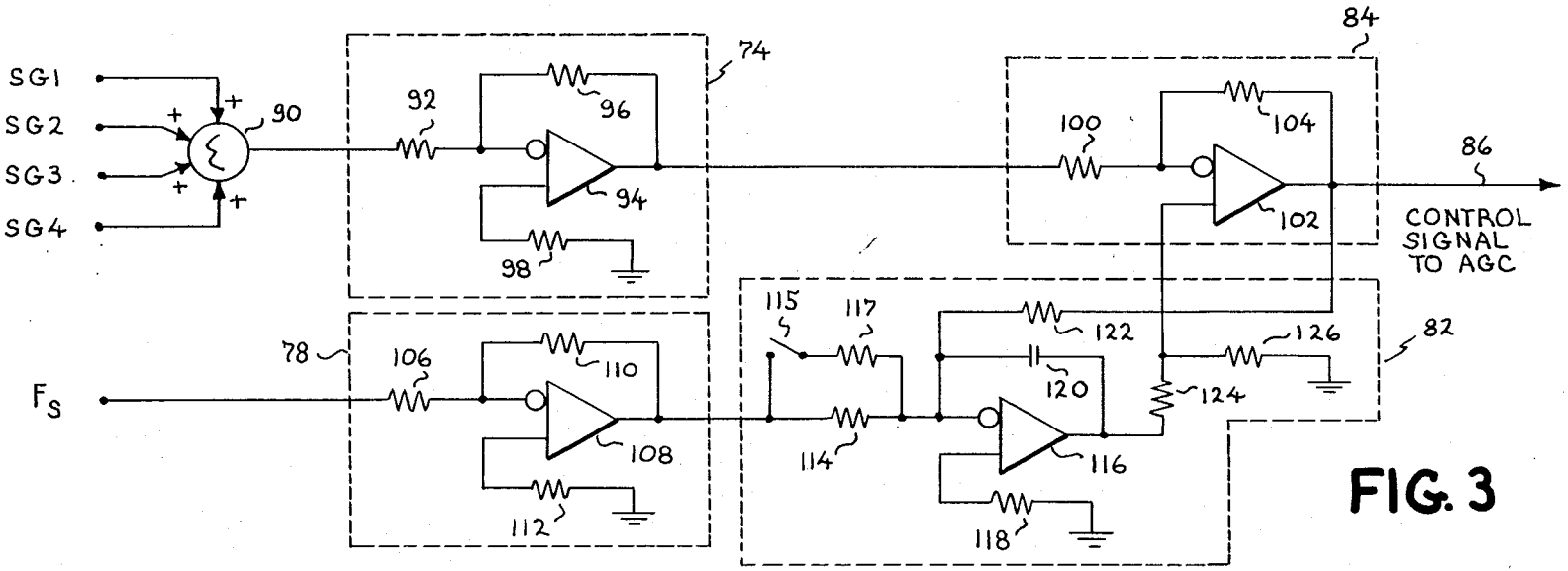
FIG. 3 is a schematic diagram illustrating one method of implementing the scheme of FIG. 2 in analog form.

FIG. 3 is an analog embodiment of the functional depiction of FIG. 2. In FIG. 3, four strain gage signals (SG1–SG4) are shown as is the signal $F_S$ from the load cell. The four strain gage signals SG1 through SG4 are all applied, in a positive sense, to a summing junction 90 such that the sum thereof is applied by way of an input resistor 92 to the inverting input of an operational amplifier 94 (block 74). The amplifier 94 has a feedback resistor 96 connected between its output and its inverting input and its non-inverting input is connected by way of a resistor 98 to ground. Scaling operational amplifier 94 in this case is such as to provide proper scaling and to effect an averaging of the signals applied to summing junction 90. The output of operational amplifier 94 is applied by way of resistor 100 to the inverting input of a second operational amplifier 96 having a feedback resistor 104 connected between its output and its inverting input. The output of this operational amplifier on line 86 is the control signal for the AGC system.

The $F_S$ signal (the force signal) is applied to gain block 78 having an input resistor 106 connected between the $F_S$ signal and the inverting input of operational amplifier 108 having a feedback resistor 110. The non-inverting input of operational amplifier 108 is connected to ground by way of a resistor 112. The output of block 78 is applied to integrating block 82 which is shown comprised of an input resistor 114 connected to the inverting input of an operational amplifier 116 whose non-inverting input is connected to ground by way of resistor 118. A capacitor 120, as is customary in the art, is connected between the output and the inverting input of operational amplifier 116 such that an integrating function is performed. The output of operational amplifier 116, the integrated signal, is applied by way of an impedance matching network including resistors 124 and 126 to the non-inverting input of an operational amplifier 102 (block 84) whose output is connected by way of resistor 122 to the inverting input of operational amplifier 116. The one-to-one correspondence between FIG. 2 and FIG. 3 is believed readily apparent and the overall functions of these two depictions are identical.

For purposes of completeness and to complete the description of FIG. 3, an initialization circuit comprising a series arrangement of a switch 115 and a resistor 117 is connected in parallel with resistor 114 of block 82. When the workpiece first enters the stand roll bite, (e.g., as sensed by the force signal $F_S$ rising to some specified value) switch 115 is momentarily closed. This will serve to reduce the input resistance to the inverting input of amplifier 116 and hence reduce the time constant of the integrating function block 82. As an illustration, this time constant might be reduced to 50 milliseconds. As such, the outputs of amplifier 108 on line 86 will rapidly be forced to the same value as an initialization after a short period of time, e.g., 55 milliseconds, switch 115 is opened and operation beings as earlier described.

While there has been shown and described what are at present considered to be the preferred embodiments of the present invention, modifications thereto will readily occur to those skilled in the art. As was indicated, the present invention could be implemented by analog form such as is illustrated in FIG. 3 or in digital form using a simple microprocessor using the functional description shown in FIG. 2. It is not desired, therefore, that the present invention be limited to this specific embodiment shown and described and it is intended to cover in the appending claims all such modifications that fall within the true spirit and scope of the invention.

What is claimed:

1. For use in conjunction with a rolling mill stand having a housing for supporting roll elements for reducing the thickness of a workpiece passed therebetween and gap adjusting means for adjusting the gap between said roll elements, means for controlling said gap adjusting means comprising:

(a) means for producing a force signal representing the force occasioned by the presence of the workpiece between the roll elements;

(b) means for producing a strain signal representing the strain forces produced in the mill housing by the presence of the workpiece between the roll elements;

(c) means for combining said force signal and said strain signal to develop a control signal; and, (d) gage control means responsive to said control signal for controlling said gap adjusting means.

2. The invention in accordance with claim 1 wherein said combining means includes:

(a) means to integrate the difference between said control signal and said force signal to provide an integral signal; and, (b) means to combine said strain signal and said integral signal to provide said control signal.

3. The invention in accordance with claim 2 wherein said means to integrate has a transfer function Z represented by the relationship:

$$Z=K/S,$$

wherein,

S=Laplace transformer operator; and,

K=a constant.

4. The invention in accordance with claim 3 wherein K has a value in the range of 0.1 to 0.03.

5. For use in conjunction with a rolling mill stand having a housing for supporting roll elements for reducing the thickness of a workpiece passed therebetween, and gap adjusting means for adjusting the gap between said roll elements, the method of controlling said gap adjusting means comprising:

(a) producing a force signal representing the force occasioned by the presence of the workpiece between the roll elements;

(b) producing a strain signal representing the strain forces produced in the mill housing by the presence of a workpiece between the roll elements;

(c) combining said force signal and said strain signal to develop a control signal; and, (d) controlling the gap adjusting means of the mill as a function of said control signal.

6. The method in accordance with claim 5 wherein said step of combining includes the steps of integrating a difference between said control signal and said force signal to provide an integral signal and combining said strain signal and said integral signal to provide said control signal.

7. The method in accordance with claim 6 wherein said integrating step provides a transfer function Z represented by the relationship $Z=K/S$, wherein S is the Laplace transformer operator and K is constant.

8. The method in accordance with claim 7 wherein K has a value in the range of 0.1 to 0.3.

* * * * *

Disclaimer 4,491,000.— *Paul E. Dornbusch*, Roanoke, Va. METHOD AND APPARATUS FOR IMPROVED SENSING OF ROLL SEPARATION FORCE IN A ROLLING MILL. Patent dated Jan. 1, 1985. Disclaimer filed June 7, 1989, by the assignee, General Electric Company.

Hereby enters this disclaimer to claims 1 and 5 of said patent.

[*Official Gazette August 8, 1989* ]